US007500375B2

(12) United States Patent
Cleave et al.

(10) Patent No.: US 7,500,375 B2
(45) Date of Patent: Mar. 10, 2009

(54) APPARATUS FOR FORMING A GUTTER CAP

(75) Inventors: Jeffrey Van Cleave, Troy, MI (US); Eugene G. Eichhorn, Pinckney, MI (US); Matthew S. Damron, Ypsilanti, MI (US); Joseph W. Pawlow, Redford, MI (US)

(73) Assignee: Van Mark Products, Farmington Hills, MI (US)

( * ) Notice: Subject to any disclaimer, the term of this patent is extended or adjusted under 35 U.S.C. 154(b) by 583 days.

(21) Appl. No.: 11/064,604

(22) Filed: Feb. 24, 2005

(65) Prior Publication Data

US 2006/0185259 A1 Aug. 24, 2006

(51) Int. Cl.
*B21D 11/10* (2006.01)
*B21D 7/02* (2006.01)

(52) U.S. Cl. ..... 72/319; 72/217

(58) Field of Classification Search ..... 72/214–219, 72/206, 319, 321, 176, 177, 320, 387
See application file for complete search history.

(56) References Cited

U.S. PATENT DOCUMENTS

| | | | | | |
|---|---|---|---|---|---|
| 40,951 | A | * | 12/1863 | Scofield | 72/388 |
| 475,299 | A | | 5/1892 | Colling | |
| 1,636,744 | A | * | 7/1927 | Johanson | 72/217 |
| 2,907,366 | A | * | 10/1959 | Wilson, Sr. | 72/216 |
| 3,043,360 | A | * | 7/1962 | Hutchison | 72/219 |
| 3,906,784 | A | * | 9/1975 | Coulstring | 73/850 |
| 4,133,197 | A | * | 1/1979 | Allen | 72/12.8 |
| 4,404,775 | A | | 9/1983 | Demartini | |
| 4,467,633 | A | * | 8/1984 | McEwen et al. | 72/203 |
| 4,497,146 | A | | 2/1985 | Demartini | |
| 4,796,390 | A | | 1/1989 | Demartini | |
| 5,333,417 | A | | 8/1994 | Demartini | |
| 6,003,357 | A | * | 12/1999 | Brown | 72/321 |
| 6,098,345 | A | | 8/2000 | Demartini | |
| 6,308,464 | B1 | | 10/2001 | Demartini | |
| 6,732,477 | B1 | | 5/2004 | Richard | |

OTHER PUBLICATIONS

Gutter Wizards, Circle 160, Qualified Remodeler, Aug. 2003, p. 1.

* cited by examiner

*Primary Examiner*—Dana Ross
*Assistant Examiner*—Debra M Sullivan
(74) *Attorney, Agent, or Firm*—Brooks Kushman P.C.

(57) ABSTRACT

A gutter cap forming tool is provided for use in a method of forming a gutter cap from a sheet stock blank. A flange of the gutter cap is initially formed by a bending brake or a flange bender. A roll forming operation is performed to form a reversely-turned arcuate bend in the gutter cap. The gutter cap is installed with either an extruded bracket or a molded bracket that secures the gutter cap to a building and a gutter.

12 Claims, 7 Drawing Sheets

Fig. 4.
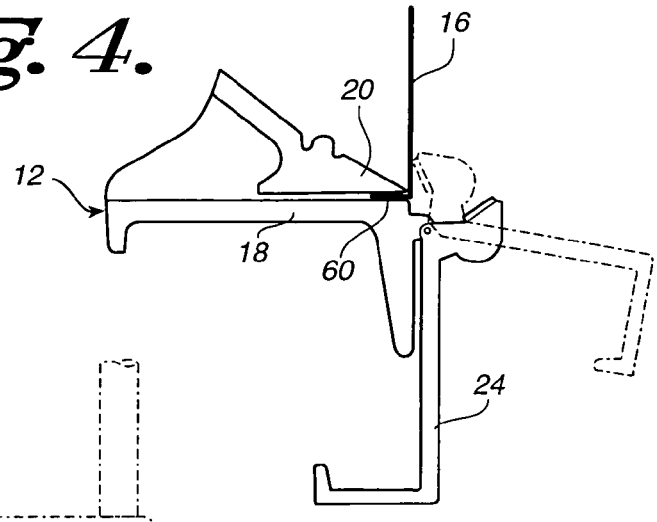
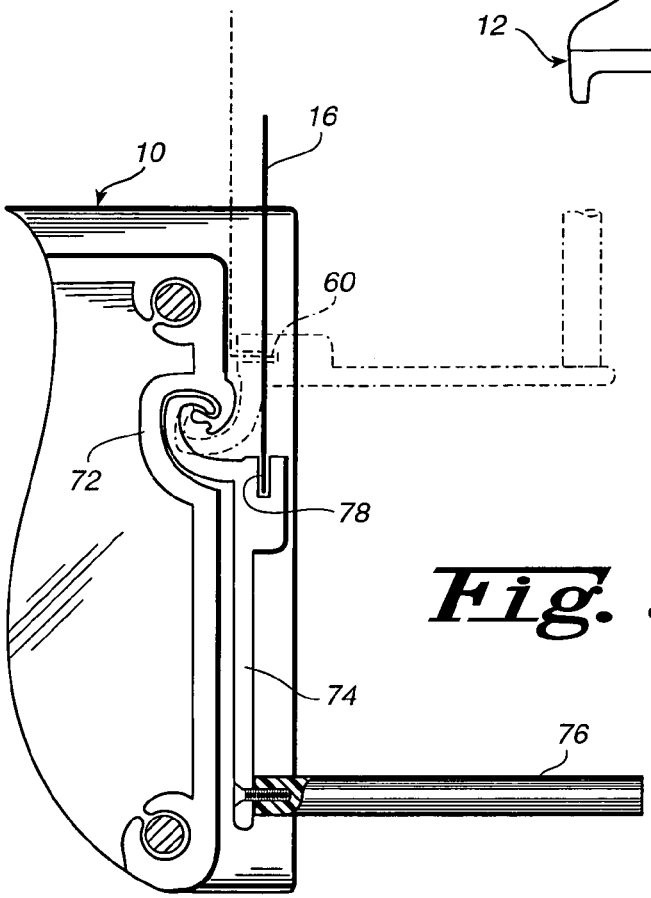
Fig. 5.
Fig. 6.
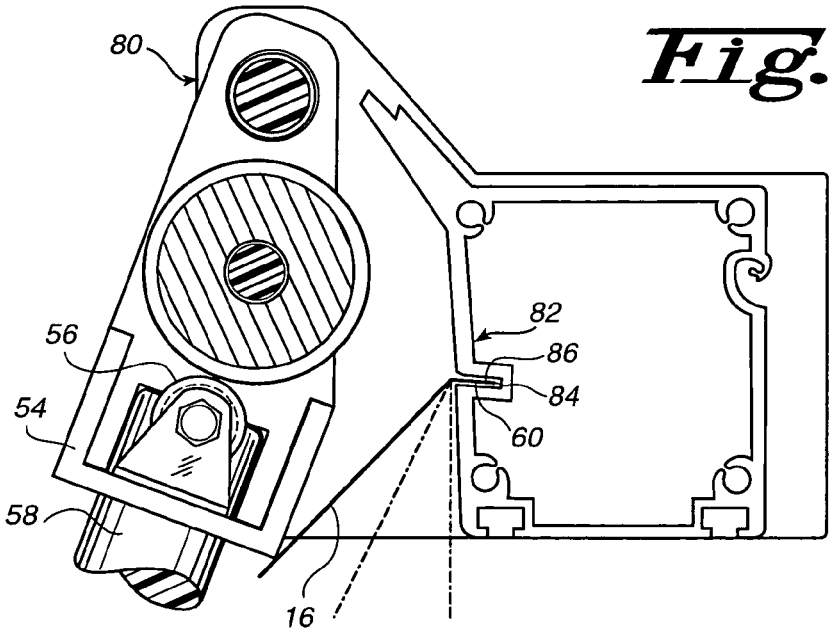

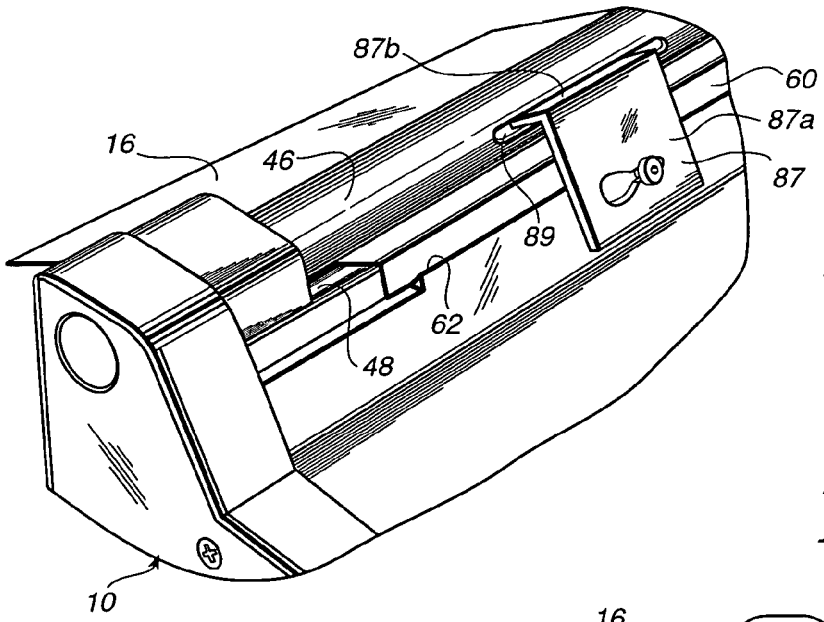
Fig. 7.
Fig. 8.
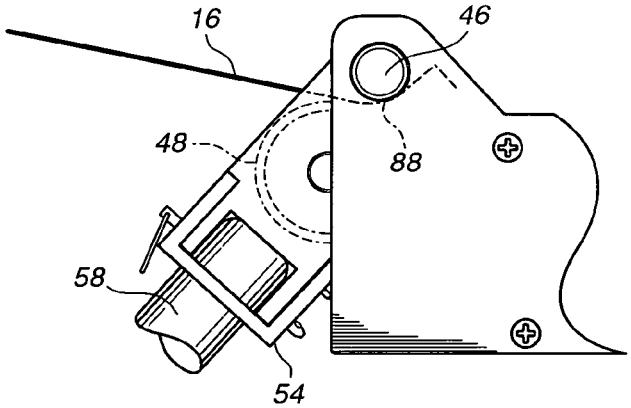
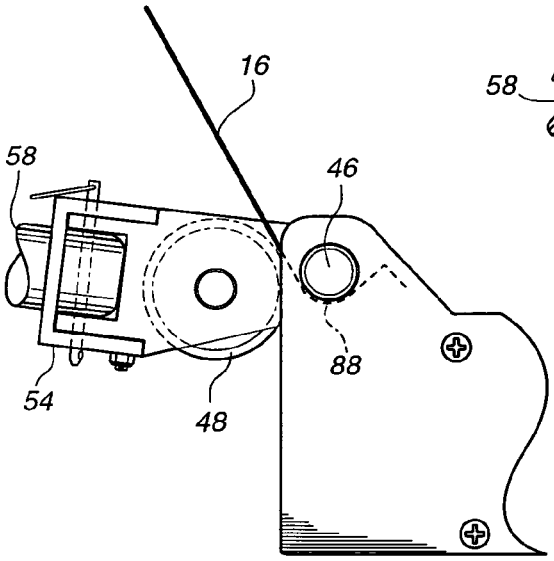
Fig. 9.
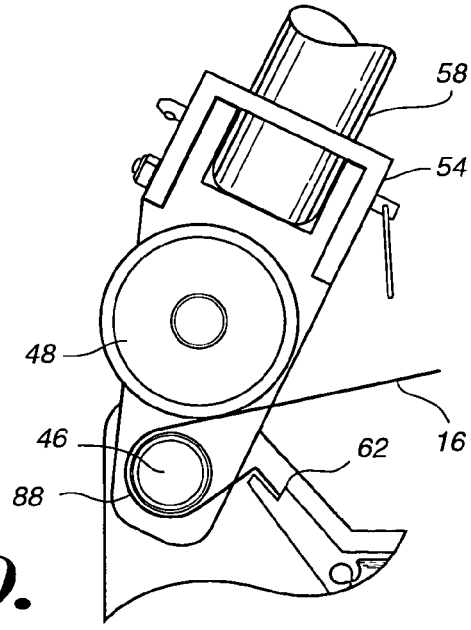
Fig. 10.

Fig. 11.
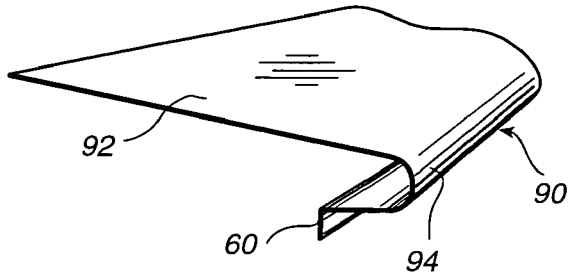
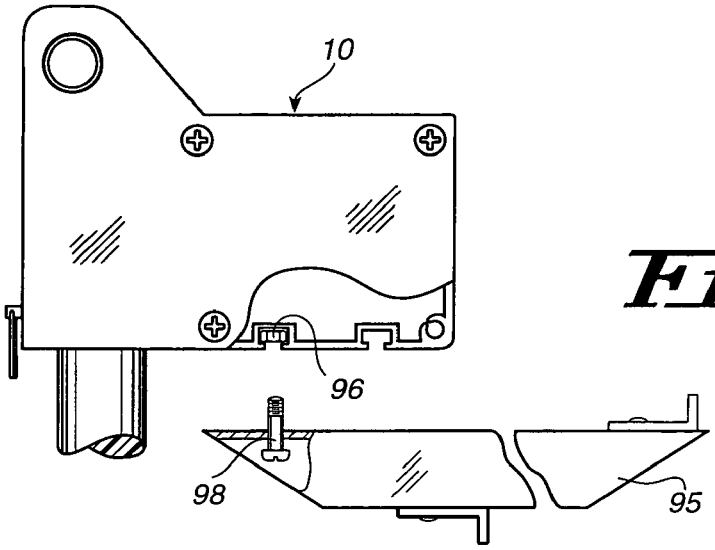
Fig. 12.
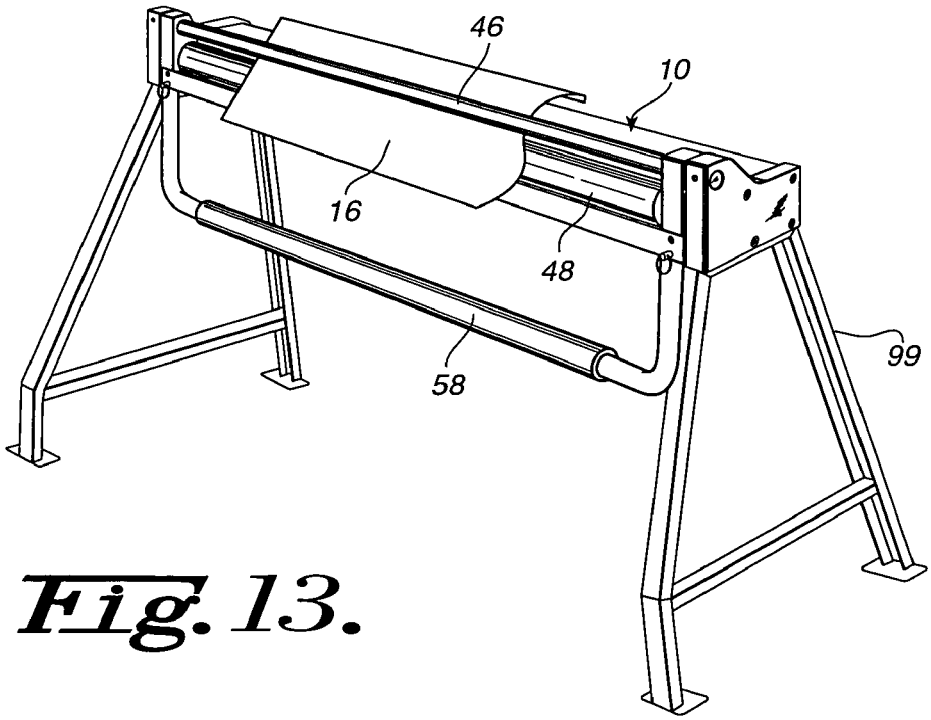
Fig. 13.

APPARATUS FOR FORMING A GUTTER CAP

BACKGROUND OF THE INVENTION

1. Field of the Invention

The present invention relates to a gutter cap, a gutter cap bracket and a gutter cap forming tool that may be used to make a gutter cap assembly.

2. Background Art

Gutters are provided on houses and other buildings to collect rain water flowing off of a roof and direct the water to down spouts that in turn direct the water away from the foundation of the house or building. While gutters perform a valuable function, the effectiveness of gutters is adversely affected by the accumulation of debris in the gutters. The flow of water in gutters may be blocked by an accumulation of debris that may form a dam preventing water from flowing through the gutters to the down spout. Gutters may overflow if the water is prevented from flowing through the gutter. Water flowing off of the roof that overflows the gutters defeats the purpose of the gutters. Debris in gutters can also lead to the formation of ice dams on the roof that can damage the roof of the building.

Cleaning gutters is a difficult and sometimes dangerous chore. A person generally must use a ladder to reach a clogged gutter to manually remove debris. Debris such as leaves, seeds, pine needles, twigs and other material may fall on a roof and may be washed into the gutters where it may accumulate. While hand tools and hose attachments have been developed to make the process of cleaning gutters less difficult, this is one chore that homeowners would rather avoid.

Gutter caps have been developed that cover the top of a gutter to prevent debris from being deposited in the gutter. Gutter caps allow water to flow around an arcuate flow path to the underside of the gutter cap as a result of the surface tension of the water.

One problem associated with gutter caps is that they are generally fabricated off-site in a factory and shipped in predetermined lengths to a job site where they are cut and assembled. Prefabricated gutter caps are relatively costly. There is a need for a gutter cap that may be made to custom sizes without unnecessary scrap or waste that is associated with gutter caps that are provided in predetermined lengths.

Prefabricated gutter caps are generally only available in aluminum and in a limited number of colors. There is a need for a tool for forming gutter caps on site that may be made of a variety of different materials and may be provided in a wide range of colors to match the wide range of aluminum and vinyl siding colors that are currently available.

Gutter caps that are currently available generally require that the gutter be removed and replaced at a lower height on the house or building to provide the proper pitch for the gutter cap so that the water may flow down the roof, across the gutter cap and into the gutter while preventing debris from entering the gutter. In addition, prefabricated gutter caps tend to be difficult to install because it is hard to hold a long length of gutter cap material in place while it is being secured to a gutter on a building.

Installation systems used with prior art gutter caps generally require brackets that may cause the gutter cap to interfere with gutter spikes that are used to secure the gutter to a building. Generally, the brackets for a gutter cap are independent from other gutter mounting hardware such as gutter spikes and sleeves. Frequently, gutter caps must be notched to accommodate gutter spikes and sleeves. There is a need for gutter cap assembly system that may be used without interfering with gutter spikes and sleeves while providing a simple installation procedure.

Prior art brackets generally have fastener receptacle holes that are difficult to locate while standing on a ladder and working in the limited space provided between the gutter and gutter cap. There is a need for a bracket that is easy to install and constrains the gutter cap with or without a fastener.

Recently, a gutter cap forming tool known as the Gutter Wizard® was developed that is currently being offered at the website "BuildingSolution.com". The Gutter Wizard® product is an on-site gutter cap fabrication tool. While the ability to provide an on-site gutter fabricating tool offers certain advantages, the Gutter Wizard® tool requires that a flange be formed in a sheet stock blank using a separate bending brake tool. The flange is inserted lengthwise into an L-shaped longitudinally extending slot in the Gutter Wizard® tool. The Gutter Wizard® tool tends to be difficult to use because it is difficult to slide the flange, full length, into the tool. This is particularly the case if the flange is improperly formed and is longer than the size of the L-shaped longitudinally extending slot. Also, if the flange is disposed at angle that varies substantially from 90°, it can be difficult to insert in the tool.

Gutter caps made with the Gutter Wizard® tool suffer from variation and distortion in the gutter cap shape that may be caused by bending the forming rolls during the forming process. Distortion is a particular problem with thicker gauge material that may be used to form the gutter cap.

Gutter caps made with the Gutter Wizard® tool are not well suited for retrofit jobs on which gutters are hung at normal gutter height which is about 1.5 inches below the roof edge. The Gutter Wizard® tool has a range of forming motion of only about 175° about a stationary ¾" diameter roller and the blank springs back to a different degree depending upon the thickness and material of the blank. For example, 0.019 aluminum sheet springs back 75° to 100° and 0.027 aluminum sheet springs back 42° to 133°. Typically, more than 2 inches of spacing is required between the top of the gutter and the roof edge which necessitates removing and remounting the gutter for most retrofit jobs.

There is a need for an efficient, all-in-one tool for on-site fabrication of gutter caps. It is important that the tool be easy to use and capable of fabricating gutter caps from standard sheet blanks of different materials and thickness. It is also important that the gutter cap fabrication tool be lightweight and portable for on-site applications.

The above problems and needs are addressed by applicant's invention as summarized below.

SUMMARY OF THE INVENTION

According to one aspect of the present invention, a tool is provided for forming a sheet form blank into a gutter cap. The tool may include a tool housing including a right roll support and a left roll support for a stationary roll that extends between the roll supports. A moveable roll is pivotally supported relative to the roll supports and is arcuately moveable about the stationary roll while remaining in a parallel orientation relative to the stationary roll. A flange retaining lip is formed on the tool body near the stationary roll. The blank is inserted between the stationary roll and the moveable roll. The flange is moved into engagement with the flange retaining lip in a direction that is normal to the flange. A handle engages the moveable roll to move the moveable roll in an arc around the stationary roll and bend a portion of the blank into a reversely-turned arcuate shape with a relatively flat portion spaced from and overlying the flange.

Another aspect of the invention relates to providing a tool for forming a sheet form blank into a gutter cap. The tool includes a tool housing that is provided with a right roll support and a left roll support. A stationary roll extends between the roll supports. A moveable roll is pivotally supported relative to the roll supports to be arcuately moveable about the stationary roll while remaining in a parallel orientation relative to the stationary roll. A retainer receives the flange with the remainder of the blank extending between the stationary roll and the moveable roll. A support brace is assembled to the moveable roll and is disposed on the opposite side of the moveable roll relative to the stationary roll. The support brace backs up the moveable roll to resist deflection of the moveable roll as the moveable roll bends the portion of the blank around the stationary roll. A handle acts on the moveable roll to move the moveable roll in an arc around the stationary roll and bend a portion of the blank into a reversely-turned arcuate shape with a relatively flat portion spaced from and overlying the flange.

Another aspect of the invention relates to providing a tool for receiving a sheet formed blank with a flange formed on one edge into a gutter cap. The tool comprises the tool body that supports a stationary roll and a movable roll that is pivotally supported by the tool body relative to the stationary roll. The moveable roll is arcuately moved about the stationary roll to form the blank around the stationary roll while remaining in a parallel orientation relative to the stationary roll. A retainer formed on the tool body near the stationary roll holds the flange with the blank being inserted initially between the stationary roll and the moveable roll. A member engages the moveable roll to move the moveable roll in an arc of more than 180° around the 11/16" diameter stationary roll to bend a portion of the blank into a reversely-turned arcuate shape with a cap portion spaced from and overlying the flange. In particular, the moveable roll may be moved in an arc of 210° around the stationary roll. The blank springs back after forming depending upon the thickness and material of the blank. For example, 0.019 aluminum sheet springs back 35° to 175° and 0.027 aluminum sheet springs back to 180°.

Other aspects of the present invention as it relates to the tool for forming a gutter cap are summarized below. The tool may also include a bending brake. The bending brake may have a clamping member, an anvil and a bending member that are used to form a flange on a first edge of the blank. The flange is disposed at an angle relative to the remainder of the blank. Instead of a bending brake, a flange bender may be provided on the tool housing. The flange bender may include a slot for receiving one edge of the blank with the remaining portion of the blank extending outwardly from the tool housing. The support brace may be pressed against the remaining portion of the blank to form the flange. Alternatively, a flange bender may be provided on the tool housing by a bending leaf that is pivotally attached to the tool housing. The bending leaf may have a slot that receives a first portion of the blank comprising one edge of the blank with a second portion of the blank comprising the portion of the blank extending from the slot. The blank is bent to form the flange as the bending leaf is pivoted and the second portion of the blank is forced into engagement with a forming surface on the tool housing.

Other aspects of the tool made according to the present invention may include providing a retainer that is in the form of a lip defining a line of contact with the first edge of the blank. The blank may be inserted between the stationary roll and the moveable roll so that the lip retains the edge of the blank as the blank is bent into the reversely turned arcuate shape. The retainer may be formed as an open slot having a face surface and a base wall that is oriented at an acute angle relative to the face surface.

According to another aspect of the invention, the tool may include an anti-deflection die that is secured to the tool housing and has a portion that contacts the stationary roller to oppose deflection of the stationary roller as the moveable roller is moved about the stationary roll to bend the blank. The anti-deflection die may be an L-shaped member having a first leg that is secured in a face-to-face relationship relative to a mounting surface of the tool housing. The portion of the die that contacts the stationary roller may be a second leg that has a distal end that is received in a slot formed in the stationary roller.

The tool may include an anti-deflection roller forming part of the support brace that rolls against the opposite side of the moveable roll from the stationary roll as the moveable roll bends the portion of the blank into the reversely-turned arcuate shape.

According to another aspect of the present invention, a gutter cap assembly is provided for a roof of a building having a water directing layer. The roof may have a slanted top surface and a vertically extending face to which a gutter is attached. The assembly comprises a gutter cap having an interstitial planar portion that is received between the top surface of the roof and the water directing layer. A cap portion extends from the interstitial planar portion over and substantially across the top of the gutter. A reversely-turned radiused portion is provided at the opposite end of the cap portion from the interstitial planar portion. The radiused portion is spaced from the gutter to define a gap through which water is directed by surface tension. An anchor flange is provided at the opposite end of the radiused portion from the cap portion. A plurality of brackets are provided wherein each bracket has an inner end secured to the vertically extending face by a fastener, an intermediate receptacle formed on the bracket to which the anchor flange is secured by at least one retaining lip, and an outer end engaging a distal lip of the gutter.

According to other aspects of the invention as they relate to the gutter cap assembly, the gutter cap assembly may be formed from a blank of expanded metal mesh. The bracket may be extruded in a direction perpendicular to a line extending between the inner end and outer end of the bracket and may be cut to a desired width perpendicular to the direction in which the bracket is extruded. The gutter cap assembly may also include a slot formed in the intermediate receptacle of the bracket as the bracket is extruded. The cap portion is preferably disposed at an angle that is more horizontal than the interstitial planar portion. The water directing layer may be a layer of roofing material such as asphalt or fiberglass shingles, standing seam metal roofing, tile or slate.

According to another aspect of the invention, a bracket is provided for a gutter cap that is assembled to a gutter having a facing wall and a gutter lip. The gutter cap has a cap portion, a reversely turned portion and a flange. The bracket comprises a main portion extending from the gutter lip to the facing wall. A flange receiving portion is provided against which the flange is secured when the gutter cap is installed. A bulbous support portion is received in the reversely turned portion of the gutter cap when the gutter cap is installed.

According to another aspect of the invention, a bracket is provided for a gutter cap that is assembled to a gutter having a facing wall and a gutter lip. The gutter cap has a cap portion, a reversely-turned portion, and a flange. The bracket comprises a main portion extending from the gutter lip to the facing wall and a flange-receiving portion against which the flange is secured when the gutter cap is installed. At least one retaining lip is disposed adjacent the flange receiving portion to constrain the flange of the gutter cap.

According to another aspect of the invention as it relates to bracket structure, a bracket for a gutter cap is provided that has a facing wall, a gutter lip, a cap portion, a reversely-turned portion and a flange as described above. The bracket further comprises a main portion extending from the gutter lip to the facing wall and a flange receiving portion against which the flange is secured when the gutter cap is installed. A nail receiving bore is formed through the main portion of the bracket and extends from the lip to the facing wall. Alternatively, the bracket may be constructed with a nail receiving bore formed at least in part in the main portion of the bracket. The nail receiving bore extends from the flange receiving portion to the facing wall.

The above features and objects of the invention will be better understood in view of the attached drawings and following detailed description of the preferred embodiments.

BRIEF DESCRIPTION OF THE DRAWINGS

FIG. 4 is a fragmentary diagrammatic view showing the bending brake of FIG. 1 forming a flange on a blank;

FIG. 5 is a fragmentary partial side elevation view of a gutter cap forming tool having an integrated flange bender in which the blank has been inserted with phantom lines showing the forming tool after forming a flange on the blank;

FIG. 6 is a fragmentary partial side elevation view showing an alternative embodiment of an integrated flange bender forming the flange on the blank;

FIG. 7 is a fragmentary perspective view showing the blank with the flange inserted in a retainer formed on the gutter cap forming tool housing;

FIG. 8 is a fragmentary side elevation view of the gutter cap forming tool at an initial stage of forming the blank;

FIG. 9 is a fragmentary side elevation view of the gutter cap forming tool at an intermediate stage of forming the blank;

FIG. 10 is a fragmentary side elevation view of the gutter cap forming tool after the forming step is completed;

FIG. 11 is a fragmentary perspective view of a gutter cap made according to one embodiment of the present invention;

FIG. 12 is a fragmentary side elevation view of the gutter cap forming tool illustrating an approach to securing the tool to a bending brake;

FIG. 13 is a perspective view of the gutter cap forming tool and a support stand;

DETAILED DESCRIPTION OF THE PREFERRED EMBODIMENT(S)

Figure 1:
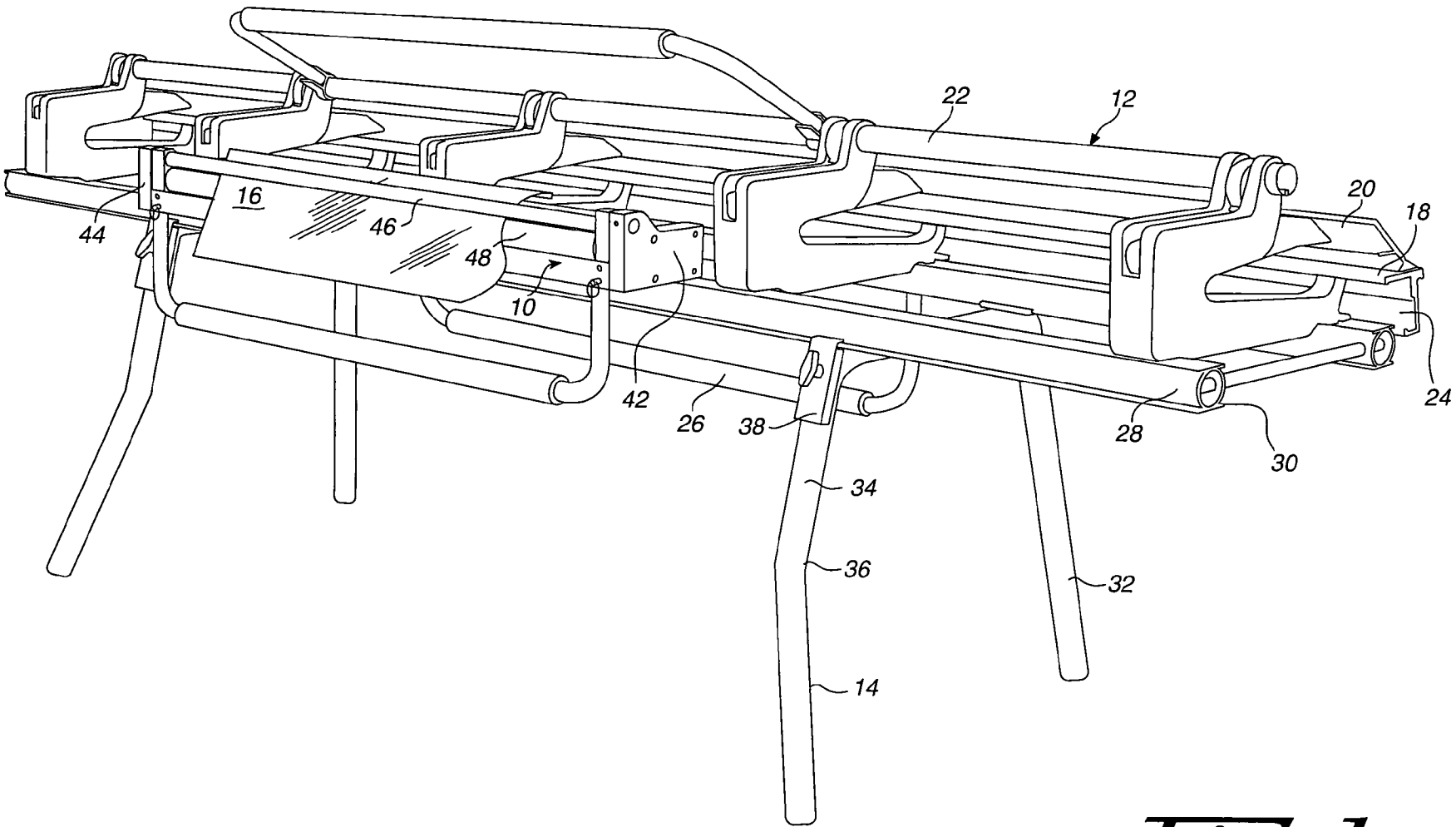
FIG. 1 is a perspective view of a bending brake having a gutter cap forming tool.

Referring to FIG. 1, a gutter cap forming tool 10 is shown attached to a sheet metal bending brake 12. The forming tool 10 and brake 12 are supported by a stand 14. A sheet stock blank 16 is shown inserted in the forming tool 10. The sheet stock blank 16 could be aluminum, steel, copper or expanded metal. The blank 16 could be provided in any color to match siding or gutter color and may be provided in a wide range of commercially available sheet stock thicknesses.

The bending brake 12 may be a commercial portable bending brake such as bending brakes sold by Van Mark Products, assignee of this application, and identified by the model designations Mark I Series, Mark II Trim Master®, Mark IV Trim Master®, or Trim-A-Brake II. The bending brake 12 includes an anvil 18 and a clamp 20 in which a blank 16 may be inserted and locked in place by turning the cam lock bar 22. A bending leaf 24 is lifted by a handle 26 to engage the blank 16 and forming a bend in the blank 16. The bending brake 12 is supported on a pair of rails 28 that include rail flanges to which the bending brake 12 is secured.

The stand 14 includes a pair of front legs 32 and a pair of rear legs 34. Rear legs 34 include a bend 36 that directs the rear legs 34 outwardly to stabilize the stand. A clamp bracket 38 secures the rear legs 34 to a rail flange 30 of one of the rail 28. Other brackets (not shown) are also provided on the front legs 32 to secure the front legs to one of the rails 28.

The forming tool 10 includes a right roll support 42 and a left roll support 44 that supports opposite ends of a fixed roll 46. An arcuately moveable forming roll 48 is used to form the blank 16 in conjunction with fixed roll 46 as is more particularly described below with reference to FIGS. 2, 3 and 7-10.

Figure 2:
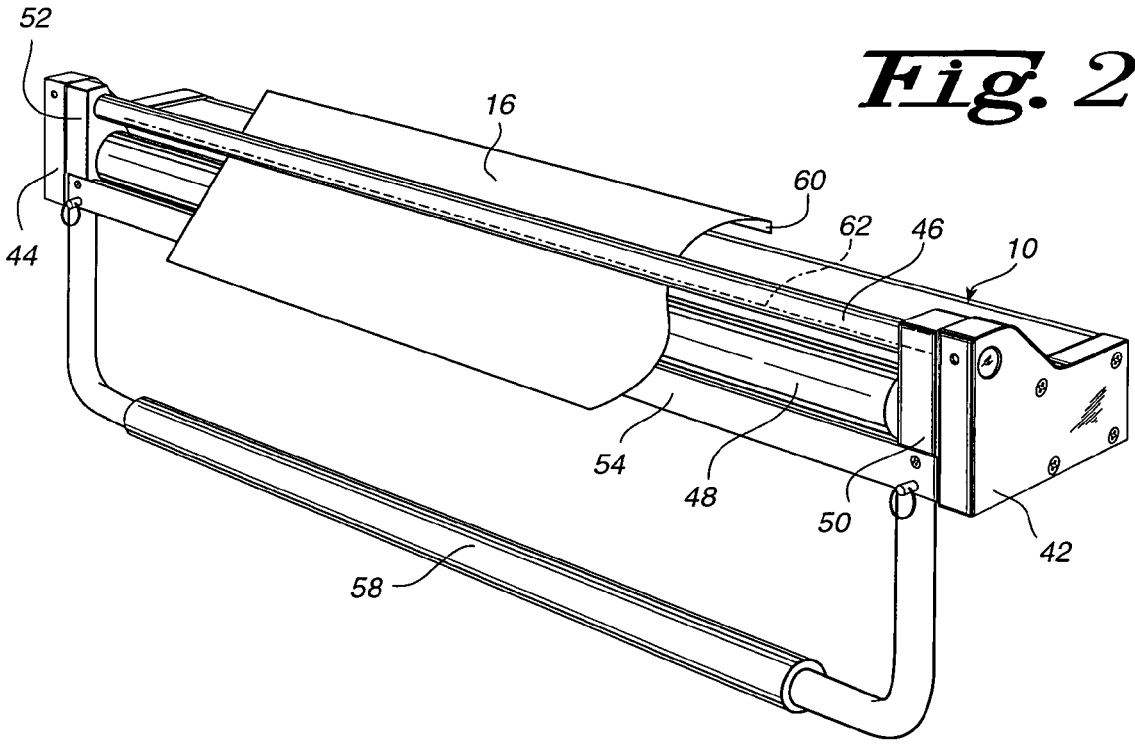
FIG. 2 is a perspective view of a gutter cap forming tool.
Figure 3:
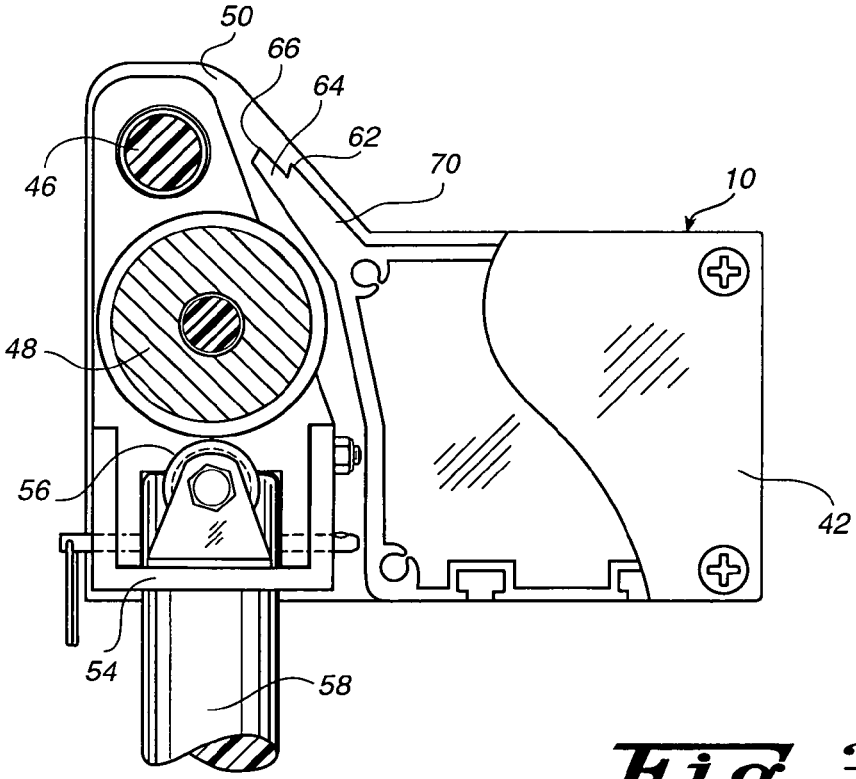
FIG. 3 is a fragmentary partial side elevation view of the gutter cap forming tool shown in FIG. 2.

Referring to FIGS. 2 and 3, gutter cap forming tool 10 is shown in isolation. A blank 16 is inserted between fixed roll 46 and arcuately moveable forming roll 48. The fixed roll 46 and forming roll 48 are received between right pivot support 50 and left pivot support 52. A support brace 54 extends between the supports 50, 52 and adjacent to the forming roll 48. As best seen in FIG. 3, an anti-deflection roller 56 may be incorporated as part of the support brace 54. The anti-deflection roller 56 is adapted to roll along the surface of the forming roll 48 as it forms the blank 16 around the fixed roll 46. Anti-deflection roller 56 allows the forming roll 48 to rotate while preventing the forming roll 48 from deflecting away from the fixed roll 46. A handle 58 is attached to the pivot supports 50, 52 and support brace 54 to provide a convenient gripping point and leverage for forming the blank 16 as the forming roll 48 is moved about the fixed roll 46.

As shown in FIG. 2, the blank 16 has a flange 60 that was previously formed in a bending brake. The flange 60 is received by a retaining lip 62. The flange 60 may be moved in a direction normal to the retaining lip 62 and remains seated on the lip 62 throughout the forming process.

Referring to FIG. 4, the step of forming a flange 60 on the blank 16 is illustrated with reference to a bending brake 12. The blank 16 is initially inserted between the clamp 20 and anvil 18. While the clamp 20 and anvil 18 securely hold the blank, bending leaf 24 is lifted to form a brake, or bend, in the blank 16 as shown. The flange 60 and blank 16 may be bent to a perpendicular relationship as shown in FIG. 4.

Referring to FIGS. 5 and 6, two embodiments of an integrated flange bender are illustrated that may be provided as part of the gutter cap forming tool 10. In each embodiment a receptacle for an edge of the blank is provided to form a ½ inch flange on the blank. The orientation of the receptacle also facilitates forming the flange to the desired angular relationship of about 90°.

In FIG. 5, the integrated flange bender 72 comprises a bending leaf 74 that is pivotally attached to the forming tool 10. The bending leaf 74 has a handle 76 that is used to manipulate the bending leaf 74. The bending leaf 74 also includes a slot 78 that is adapted to receive a fixed length of the blank 16. To form a flange 60, the bending leaf 74 is moved from the position shown in sold lines in FIG. 5 to the position shown in phantom lines in FIG. 5. After forming, the bending leaf 74 may be returned to the position shown in solid lines in FIG. 5 and the blank 16 with its flange 60 may be removed from the flange bender 72 and inserted between the rolls 46 and 48 and formed as will be described below with reference to FIGS. 7-10.

Referring to FIG. 6, an alternative embodiment of an integrated flange bender and gutter cap forming tool 80 is illustrated. The tool 80 is substantially similar to the embodiment of FIG. 3, but also includes a flange bender 82 comprising a slot 84 formed in the tool 80, that is adapted to receive an edge 86 of the blank 16. The support brace 54 is moved by the handle 58 to engage the blank 16 and form a flange 60 on the blank 16.

Referring to FIGS. 7-10, the forming tool 10 is shown in a series of steps of the gutter cap forming process. Referring specifically to FIG. 7, the forming tool 10 is shown as it would appear with the blank 16 and its associated flange 60 loaded into the tool 10. Flange 60 is held by the retaining lip 62. The remainder of the blank 16 extends between the fixed roll 46 and the moveable roll 48. An anti-deflection die 87 is shown as it is attached to the tool 10. The anti-deflection die 87 comprises a first leg 87*a* that is secured by a fastener to the tool and a second leg 87*b* that is received in a slot 89 in the fixed roll 46.

In FIG. 8, an arcuate bend 88 is shown as it initially begins to form. In the initial stage of the forming operation, the handle 58 lifts the moveable roll 48 and the support brace 54 in an arcuate path around the fixed roll 46. In FIG. 9, the handle 58 has been used to lift the moveable roller 48 and move it arcuately about the fixed roll 46. The arcuate bend 88 is formed to a greater extent as shown in FIG. 9.

In FIG. 10, the blank 16 is shown with its fully formed arcuate bend 88. The tool is designed to allow the moveable roll to move in an arc of more than 180° around the stationary roll to bend a portion of the blank into the reversely-turned portion of the gutter cap. The moveable roll may be moved in an arc of more than 200° around the stationary roll to obtain a tighter bend in the gutter cap. While the blank is formed to more than 180°, or to about 200°, depending upon the material and thickness of the blank, it will spring back. If the blank is formed around the fixed roll of 200°, the blank will spring back to provide a 180° to 195° bend in the blank.

Referring to FIG. 11, a gutter cap 90 is shown to include a planar portion 92 and a reversely-turned arcuate bend 94. The planar portion 92 overlies the flange 60 that was initially formed by the bending brake 12 or a flange bender as described with reference to FIGS. 5 and 6.

Referring to FIG. 12, the forming tool 10 is shown in a position where it is ready to be attached to a conventional bending brake 12. The forming tool 10, as illustrated, may have a bracket 95 that secures the tool 10 to the bending brake 12. A nut is retained in a receptacle 96 for receiving a fastener 98 that attaches the bracket 95 to the tool 10.

Referring to FIG. 13, a gutter cap forming tool 10 is shown attached to an alternative embodiment of a stand 99. The gutter cap forming tool 10 may be provided as a stand alone tool with its own stand or may be provided in conjunction with a bending brake 12, as shown in FIG. 1. The forming tool 10 is shown with a blank 16 inserted between the fixed roll 46 and the arcuately moveable forming roll 48. The forming roll 48 is lifted manually by means of a handle 58 as previously described to form the gutter cap.

Figure 14:
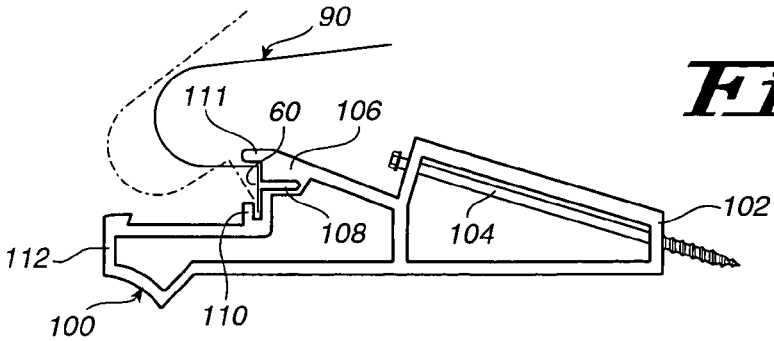
FIG. 14 is a side elevation view of one embodiment of a bracket that is used to attach the gutter cap.

Referring to FIG. 14, a bracket 100 is shown that may be formed by molding or extruding. The bracket 100 could be formed as an aluminum extrusion, but could also be formed of a different metal or of a rigid or reinforced molded resin. The bracket 100 may be formed as an extrusion having a relatively long length that is then cut into individual brackets by cutting the extruded member perpendicular to the extrusion direction. The bracket 100 may also be formed in an injection molding process as a discrete molded part.

The bracket 100 includes a face engaging end 102 and is held in place by means of a wood screw 104. An intermediate portion 106 of the bracket 100 is provided that defines a slot 108, a lower retaining lip 110, and an upper retaining lip 111. The lower retaining lip 110 and the upper retaining lip 111 together hold the flange 60 of the gutter cap 90. The slot 108 is adapted to receive a self-tapping screw (not shown) in a range of lateral locations without requiring precise alignment of the self-tapping screw with a small hole. A gutter lip engaging end 112 is provided on the opposite end from the face engaging end 102.

Figure 15:
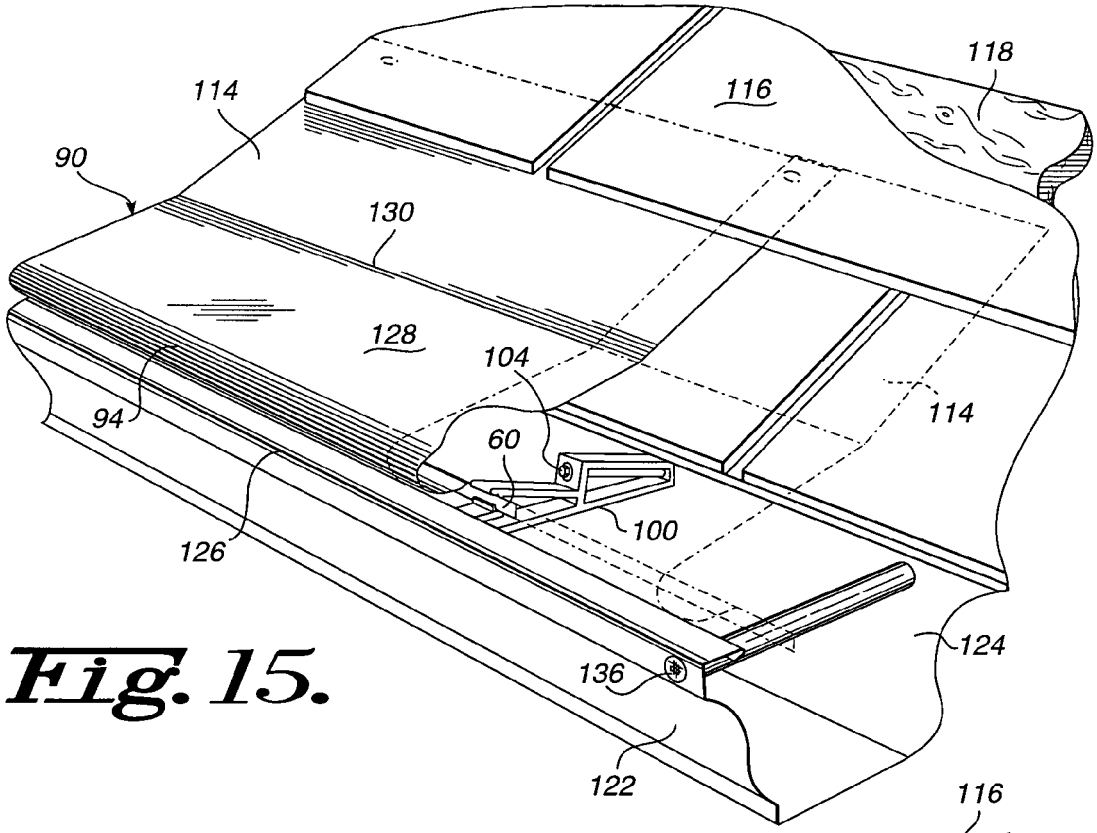
FIG. 15 is a fragmentary perspective view of the gutter cap and the bracket assembled to a building and a gutter.
Figure 16:
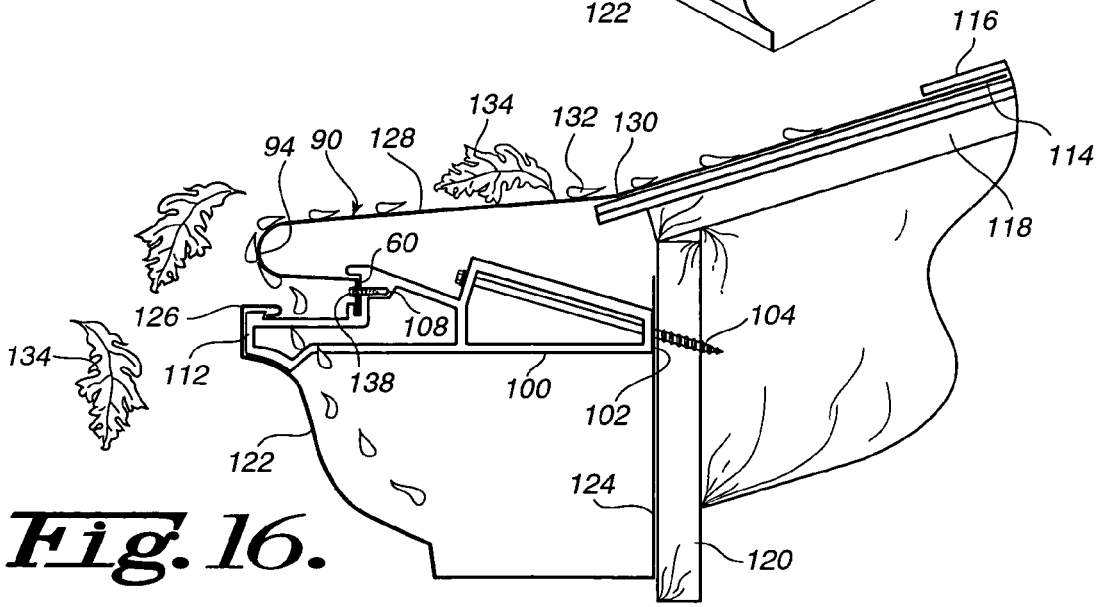
FIG. 16 is a diagrammatic side elevation view of the gutter cap secured to the building with the bracket assembled to the gutter.

Referring to FIGS. 15 and 16, installation of the gutter cap 90 is described in greater detail. An interstitial planar portion 114 of the gutter cap 90 is inserted between a layer of roofing material 116 such as a layer of shingles, standing seam metal roof, shake shingle or slate roof. The interstitial planar portion 114 is placed between the layer of roofing material 116 and the slanted roof structure 118. The roof structure also includes a face plate 120 onto which a gutter 122 is installed. An inner wall 124 of the gutter 122 is secured to the face plate 120. A gutter lip 126 is provided on the opposite side of the gutter from the inner wall 124. The gutter lip engaging end 112 of the bracket 100 may be twisted to secure the bracket 100 within the gutter lip 126. The cap portion 128 of the gutter cap 90 extends above the gutter 122 and terminates in the reversely-turned arcuate bend 94. A transition break 130 may be provided between the planar portion 114 and the cap portion 128. Rain water flowing down the layer of roofing material 116 slows upon reaching the transition break 130 causing the water to pool and flow more slowly across the cap portion 128. Upon reaching the reversely-turned arcuate bend 94, water 132 flows around the arcuate bend 94 by reason of surface tension until the water 132 contacts the flange 60, at which point the water is directed into the gutter 122. Leaves 134 are shed from the gutter cap 90 that covers the gutter 122. In the illustrated embodiment the gutter 122 is attached by gutter spikes 136. Gutter spikes 136 are used to nail the gutter 122 to the base plate 120 to secure the gutter 122 to the building.

The gutter 122 may be a new installation or may have been previously installed on the building and the gutter cap 90 may be provided as a retrofit. The face engaging end 102 is located against the inner wall 124 of the gutter 122. The bracket 100 is secured in place by the wood screw 104 that is inserted through a hole formed in the bracket. After the bracket is installed, interstitial planar portion 114 of the gutter cap 90 is inserted underneath the roofing material 116. The flange 60 may then be secured to the bracket 100 by the self-tapping screw 138 that is received in the extruded slot 108.

Figure 17:
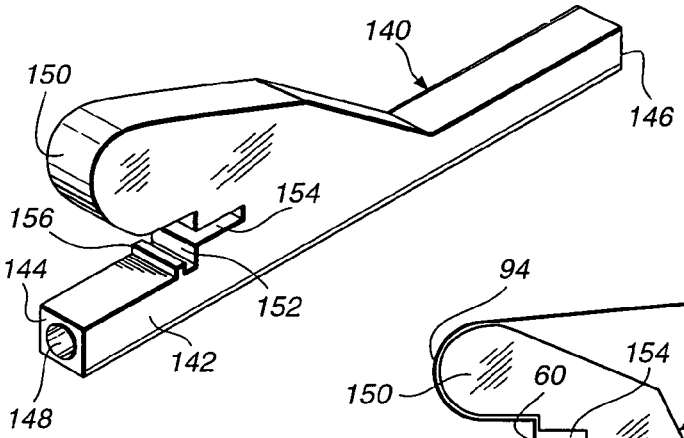
FIG. 17 is a perspective view of another embodiment of a bracket.
Figure 18:
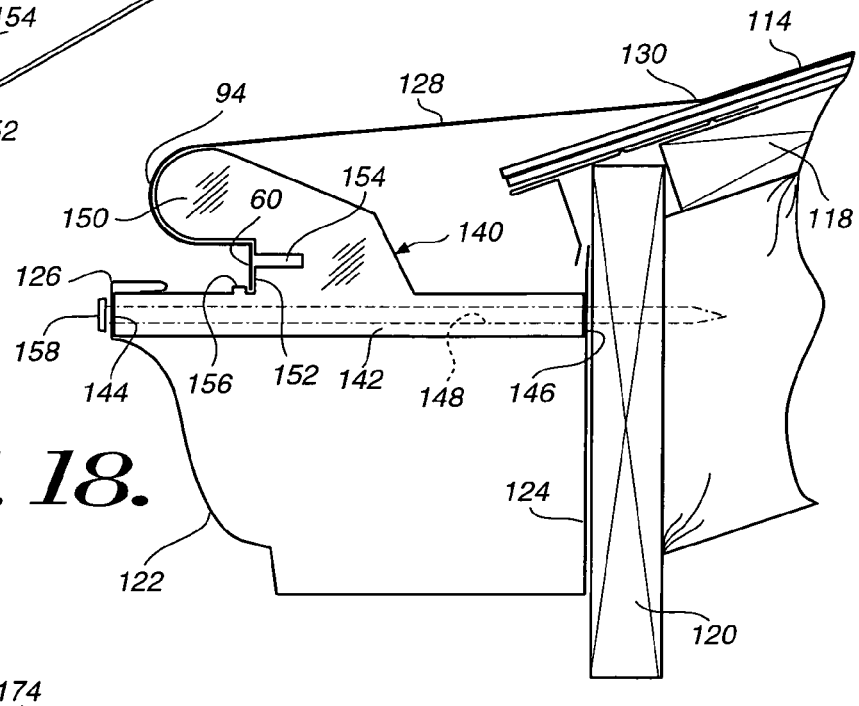
FIG. 18 is a diagrammatic side elevation view of the gutter cap secured to the building with the bracket of FIG. 17.

Referring now to FIGS. 17 and 18, an alternative embodiment of a gutter cap bracket is generally referred to by reference 140. The bracket 140 includes a main portion 142 that extends from a lip end 144 to a face end 146. Lip end 144 is adapted to engage the gutter lip 126. The face end 146 engages the face wall 124 of the gutter 122. A bore 148 extends from the lip end 144 to the face end 146. A bulbous nose portion 150 extends from an intermediate point on the main portion 142 upwardly and toward the lip end 144. The bulbous nose 150 is curved to correspond to the desired curvature of the reversely-turned arcuate bend 94 of the gutter cap 90. The nose 150 is intended to support the arcuate bend 94. A flange receiving surface 152 is provided below the nose 150 that is adapted to receive the flange 60 of the gutter cap 90. A slot 154 is provided in flange receiving surface 152. Slot 154 is adapted to receive a screw, like screw 138 shown in FIG. 16. This screw 138 may be received at any point in the slot 154 provided that the screw 104 is able to grip the edges of the slot 154. A lip 156 is provided between the flange receiving surface 152 and the lip end 144 of the bracket 140. Lip 156 is provided to retain the flange 60 against the flange receiving surface 152. The flange 60 is snapped over the lip 156 when the gutter cap 90 is assembled to the bracket 140. A nail 158 that can be a conventional gutter spike may be inserted through the gutter lip 126 and the bore 148 formed in the main portion 142 of the bracket 140. The nail 158 is driven through the inner wall 124 of the gutter 122 and secured to the face plate 120 of the building on which the gutter 122 is installed. One advantage of this embodiment of a gutter cap bracket is that gutter spikes that are normally used to retain the gutter on a building may be accommodated by the bracket 140. This reduces the number of parts and eliminates concerns regarding adapting the gutter cap to previously installed gutter spikes.

Figure 19:
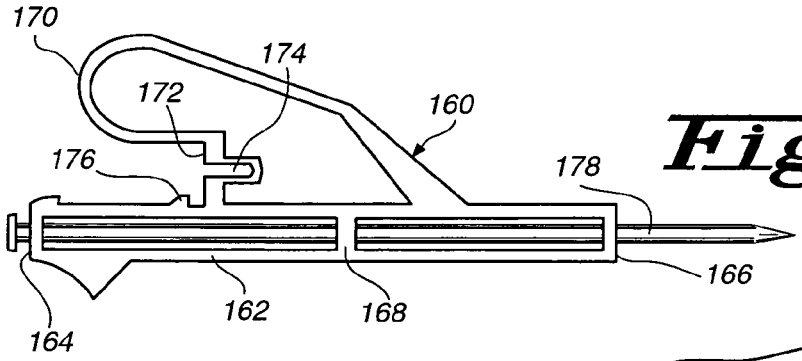
FIG. 19 is a side elevation view of another embodiment of a bracket.

Referring to FIG. 19, another alternative bracket 160 is illustrated that may be formed as an extrusion. Bracket 160 differs from bracket 140 in that it is a substantially hollow member that requires less material to form the bracket. The bracket 160 has a main portion 162 that extends from a lip end 164 to a face end 166. An intermediate wall 168 is provided between lip end 164 and face end 166. A bulbous nose portion 170 is provided above the main portion 162 and near the lip end 164 of the bracket 160. A flange receiving surface 172 is provided below the nose 170. Flange receiving surface 172 is adapted to receive the flange 60 of the gutter cap 90. A slot 174 is provided in the flange receiving surface 172. Slot 174 is intended to receive a self-tapping screw (not shown) to attach flange 60 to the flange receiving surface 172. A lip 176 is provided between the flange receiving surface 172 and the lip end 164. When the gutter cap 90 is installed, the flange 60 is snapped over the lip 176 to hold the flange near the flange receiving surface 172. A nail 178 is inserted through holes (not shown) in the lip end 164, face end 166 and intermediate wall 168 of the main portion 162 of the bracket 160. The nail 178 is a conventional gutter spike that is used to secure the gutter and gutter cap bracket to the face plate 120 of a building.

Figure 20:
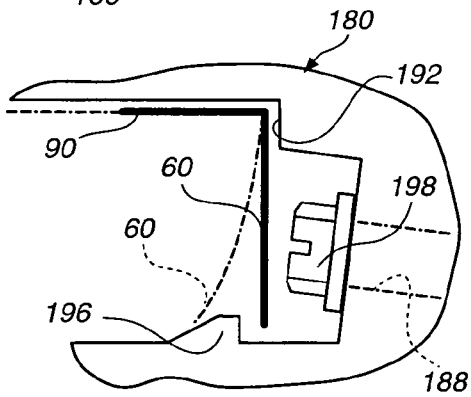
FIG. 20 is a side elevation view of another embodiment of a bracket.
Figure 21:
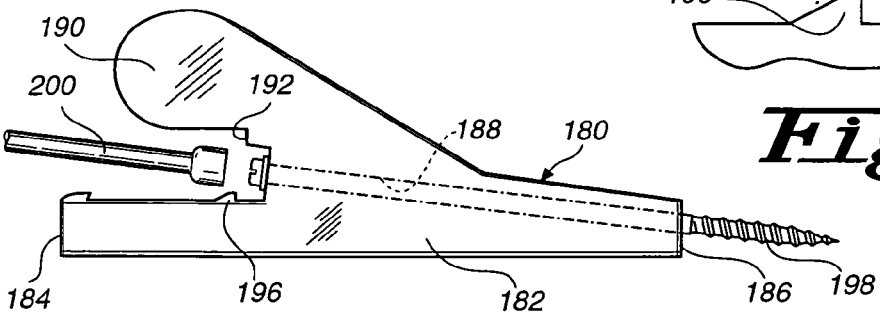
FIG. 21 is a fragmentary close-up side elevation view of a portion of the bracket shown in FIG. 20.

Referring to FIGS. 20 and 21, another alternative embodiment of a gutter cap bracket is generally referred to by reference numeral 180. Bracket 180 includes a main portion 182 that extends from a lip end 184 to a face end 186. A bore 188 is provided partially on the main portion 182. A nose 190 is formed above the main portion 182 and extends toward the lip end 184. The nose 190 is provided to support the reversely-turned arcuate bend 94 of the gutter cap 90. A flange receiving surface 192 is provided below the nose 190. A lip 196 is provided between the flange receiving surface 192 and the lip end 184 of the bracket 180. A wood screw 198 may be secured through the bore 188 that extends from the flange receiving surface 192 to the face end 186 of the bracket 180. The wood screw 198 may be driven by a screwdriver or nut running tool 200 to secure the bracket 180 to the face plate 120 of a building. The bracket 180 is preferably installed on the building before attachment of the gutter cap to the bracket.

The bracket 100 is mounted to the gutter 122 and then to the face plate 120 or fascia, with the wood screw 104, or other fastener, that is inserted through a hole formed in the bracket 100. The flange 60 is retained between lower retaining lip 110 and upper retaining lip 111. The cap 90 may then be rotated towards the roof from the position shown as a phantom line to the position shown as a solid line in FIG. 14. The end of the gutter cap 90 may then be inserted under the first or second courses of shingles. The cap 90 may then be nailed in place under the shingles. Alternatively, the bracket 100 could be secured in place by the wood screw 104, or other fastener, as previously described through the hole formed in the bracket 100. After the bracket 100 is installed, the gutter cap 90 may be inserted under the roofing layer 116 and the flange 60 could then be secured to the bracket 100 by the upper and lower retaining lips 110, 111 and, if desired, by the self-tapping screw 138 that is received in the extruded slot 108.

It should be understood that the brackets and gutter cap could be installed as new construction or as a retrofit. As noted previously, prior art systems generally require that the gutter be removed and lowered to provide proper water flow across the gutter cap.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tool for forming a sheet form blank into a gutter cap, the sheet form blank having a flange pre-formed on a first edge that extends at an angle relative to the remainder of the blank, the tool comprising:

a tool housing;

a right roll support and a left roll support provided on the tool housing;

a stationary roll extending between the roll supports;

a moveable roll pivotally supported relative to the stationary roll between the roll supports, the moveable roll being arcuately moveable about the stationary roll while remaining in a parallel orientation relative to the stationary roll;

means for retaining a flange formed on the tool housing proximate to and extending parallel to the stationary roll, the blank being inserted between the stationary roll and the moveable roll to a point at which the flange is moved into engagement with the retaining means in a direction that is normal to the flange; and a handle engaging the moveable roll to move the moveable roll in an arc around the stationary roll and bend a portion of the blank into a reversely-turned arcuate shape with a relatively flat portion spaced from and overlying the flange.

2. The tool of claim 1 further comprising an attachment apparatus for securing the tool to a bending brake having a clamping member, an anvil, and a bending member, wherein the flange is formed by clamping the blank in the bending brake and the bending member forms the flange against the anvil.

3. The tool of claim 1 wherein the retaining means defines a line of contact with the first edge of the blank, and wherein the blank is inserted between the stationary roll and the moveable roll, and wherein the retaining means retains the edge of the blank as the blank is bent into the reversely-turned arcuate shape.

4. The tool of claim 1 wherein the retaining means is formed as an open slot having a face surface and a base wall that is oriented at an acute angle relative to the face surface.

5. The tool of claim 1 wherein an anti-deflection die is secured to the tool housing and has a portion that contacts the stationary roller to oppose deflection of the stationary roller as the moveable roller is moved about the stationary roll to bend the blank.

6. A tool for forming a sheet form blank having a flange formed on a first edge of the blank into a gutter cap, the tool comprising:

a tool housing;

a right roll support and a left roll support provided on the tool housing;

a stationary roll extending between the roll supports;

a moveable roll pivotally supported relative to the stationary roll between the roll supports, the moveable roll being arcuately moveable about the stationary roll while remaining in a parallel orientation relative to the stationary roll;

a flange retaining lip formed on the tool body proximate to and extending parallel to the stationary roll, the blank being inserted between the stationary roll and the moveable roll with the flange being moved into engagement with the flange retaining lip in a direction that is normal to the flange;

a handle engaging the moveable roll to move the moveable roll in an arc around the stationary roll and bend a portion of the blank into a reversely-turned arcuate shape with a relatively flat portion spaced from and overlying the flange;

wherein an anti-deflection die is secured to the tool housing and has a portion that contacts the stationary roller to oppose deflection of the stationary roller as the moveable roller is moved about the stationary roll to bend the blank; and wherein the anti-deflection die is a L-shaped member having a first leg that is secured in a face-to-face relationship to a mounting surface of the tool housing and wherein the portion of the die that contacts the stationary roller is a second leg that has a distal end that is received in a slot formed in the stationary roller.

7. A tool for forming a sheet form blank into a gutter cap, comprising:

a tool housing;

a flange bender including means for receiving an edge of the blank and forming a flange on the blank;

a right roll support and a left roll support provided on the tool housing;

a stationary roll extending between the roll supports;

a moveable roll pivotally supported relative to the stationary roll on the roll supports to be arcuately moveable about the stationary roll while remaining in a parallel orientation relative to the stationary roll;

a retainer receiving the flange with the remainder of the blank extending between the stationary roll and the moveable roll;

a support brace is assembled to the moveable roll and is disposed on the opposite side of the moveable roll relative to the stationary roll that backs up the moveable roll to resist deflection of the moveable roll as the moveable roll bends the portion of the blank around the stationary roll;

an anti-deflection roller forming a part of the support brace that rolls against the opposite side of the moveable roll from the stationary roll as the moveable roll bends the portion of the blank into the reversely-turned arcuate shape; and a handle acting on the moveable roll to move the moveable roll in an arc around the stationary roll and bend a portion of the blank into a reversely-turned arcuate shape with a relatively flat portion spaced from and overlying the flange.

8. A tool for forming a sheet form blank having a flange formed on a first edge of the blank into a gutter cap, the tool comprising:

a tool housing;

a flange bender including a slot for receiving an edge of the blank and an arcuately moveable member that engages a portion of the blank extending from the slot;

a right roll support and a left roll support provided on the tool housing;

a stationary roll extending between the roll supports;

a moveable roll pivotally supported relative to the stationary roll between the roll supports, the moveable roll being arcuately moveable about the stationary roll while remaining in a parallel orientation relative to the stationary roll; and a handle engaging the moveable roll to move the moveable roll in an arc around the stationary roll and bend a portion of the blank into a reversely-turned arcuate shape with a relatively flat portion spaced from and overlying the flange.

9. The tool of claim 8, wherein the flange bender is provided on the tool housing, the flange bender including a slot for receiving one edge of the blank with the remaining portion of the blank extending outwardly from the tool housing, wherein a support brace may be pressed against the remaining portion of the blank to form the flange.

10. The tool of claim 8, wherein the arcuately moveable member includes a bending leaf pivotally attached to the tool housing, the bending leaf defining the slot that receives the edge portion of the blank with the balance of the blank extending from the slot, wherein the blank is bent to form the flange as the bending leaf is pivoted and the second portion of the blank is forced into engagement with a forming surface on the tool housing.

11. A tool for forming a sheet form blank having a flange formed on a first edge of the blank into a gutter cap, the tool comprising:

a tool body;

a stationary roll supported by the tool body;

a moveable roll pivotally supported by the tool body that is moveable relative to the stationary roll, the moveable roll being arcuately moveable about the stationary roll to form the blank around the stationary roll while remaining in a parallel orientation relative to the stationary roll;

means for retaining the blank that is formed on the tool body proximate to and extending parallel to the stationary roll, the blank being inserted between the stationary roll and the moveable roll with the flange of the blank being held by the retainer means; and a member engaging the moveable roll to move the moveable roll in an arc of more than 180° around the stationary roll to bend a portion of the blank into a reversely-turned arcuate shape with a cap portion spaced from and overlying the flange.

12. The tool of claim 11, wherein the moveable roll is moved in an arc of 210° around the stationary roll and the blank springs back after forming a bend in the blank measuring between 170° and 190°.

* * * * *